US010961960B2

(12) United States Patent
Suzuki

(10) Patent No.: US 10,961,960 B2
(45) Date of Patent: Mar. 30, 2021

(54) RAIL FOR HIGH-PRESSURE DIRECT INJECTION

(71) Applicant: USUI CO., LTD., Shizuoka (JP)

(72) Inventor: Shuji Suzuki, Shizuoka (JP)

(73) Assignee: USUI CO., LTD., Shizuoka (JP)

( * ) Notice: Subject to any disclaimer, the term of this patent is extended or adjusted under 35 U.S.C. 154(b) by 0 days.

(21) Appl. No.: 16/769,241

(22) PCT Filed: Aug. 6, 2018

(86) PCT No.: PCT/JP2018/029339
§ 371 (c)(1),
(2) Date: Jun. 3, 2020

(87) PCT Pub. No.: WO2019/130638
PCT Pub. Date: Jul. 4, 2019

(65) Prior Publication Data

US 2020/0340435 A1 Oct. 29, 2020

(30) Foreign Application Priority Data

Dec. 25, 2017 (JP) ..... JP2017-247196

(51) Int. Cl.
*F02M 55/00* (2006.01)
*F02M 69/00* (2006.01)
(Continued)

(52) U.S. Cl.
CPC ..... *F02M 55/025* (2013.01); *F02M 55/005* (2013.01); *F02M 69/465* (2013.01); *F02M 2200/856* (2013.01); *F02M 2200/857* (2013.01)

(58) Field of Classification Search
CPC ... F02M 55/025; F02M 55/005; F02M 69/465
(Continued)

(56) References Cited

U.S. PATENT DOCUMENTS 4,110,894 A * 9/1978 Zuev ..... B22D 17/24 164/103
10,788,002 B2 * 9/2020 Touchette ..... F02M 21/0248
(Continued)

FOREIGN PATENT DOCUMENTS

JP H10-110883 A 4/1998
JP 2001-221127 A 8/2001
(Continued)

OTHER PUBLICATIONS

International Search Report for PCT/JP2018/029339 dated Sep. 18, 2018.

*Primary Examiner* — Thomas N Moulis
(74) *Attorney, Agent, or Firm* — Yokoi & Co., U.S.A.; Toshiyuki Yokoi

(57) ABSTRACT

The present invention aims for obtaining a fuel rail for gasoline direct injection which can be used for the direct injection at a high fuel pressure of 50 MPa or more by increasing the thickness at the portion near the branch hole and using the material having high thickness for the metal seal portion while keeping the weight light and keeping the cost low. A fuel rail for gasoline direct injection made of steel and used at a fuel pressure of 50 MPa or more, the fuel rail having: a plurality of block members 2; and a pipe member 1 which connects an interval between the block members, wherein the block members 2 have: a branch hole 3 which communicates with the pipe member 1; and a metal seal portion 6 to which an injector is connected, and the hardness of the block members 2 is higher than the hardness of the pipe member 1.

2 Claims, 4 Drawing Sheets

(51) Int. Cl.
*F02M 55/02* (2006.01)
*F02M 69/46* (2006.01)

(58) Field of Classification Search
USPC ..... 123/468–470
See application file for complete search history.

(56) References Cited

U.S. PATENT DOCUMENTS

2001/0029929 A1* 10/2001 Natsume ..... F02M 55/025 123/468
2002/0020455 A1* 2/2002 Balbi ..... F02M 55/02 138/143
2003/0183292 A1* 10/2003 Otsuka ..... C22C 38/42 138/109
2004/0003795 A1* 1/2004 Kondo ..... F02M 55/025 123/447
2007/0006848 A1* 1/2007 Ricco ..... F02M 55/025 123/456
2010/0055490 A1* 3/2010 Sugihashi ..... C22C 38/32 428/596
2011/0005493 A1* 1/2011 Hirano ..... F02M 55/025 123/456
2011/0121563 A1* 5/2011 Toyoshima ..... F16L 19/0225 285/263
2011/0315122 A1* 12/2011 Straub ..... F02M 55/02 123/469
2012/0152112 A1* 6/2012 Yoshimura ..... F02M 59/445 92/169.1
2015/0034049 A1* 2/2015 Matsui ..... C22C 38/06 123/456
2015/0211463 A1* 7/2015 Hasegawa ..... F02M 55/025 123/456
2017/0260945 A1 9/2017 Soma et al.
2017/0260946 A1* 9/2017 Suzuki ..... F02M 55/025
2018/0023157 A1* 1/2018 Hayashi ..... C22C 38/002 428/544
2020/0063702 A1* 2/2020 Toyoshima ..... C23C 28/322

FOREIGN PATENT DOCUMENTS

JP 2007-127096 A 5/2007
JP 2010-216431 A 9/2010
JP 2017-14900 A 1/2017
JP 2017-106383 A 6/2017
WO 2016/042897 A 3/2016

* cited by examiner

RAIL FOR HIGH-PRESSURE DIRECT INJECTION

TECHNICAL FIELD

The present invention relates to a rail of gasoline direct injection capable of bearing an increment of pressure. The rail is used for the direct injection at a high fuel pressure of 50 MPa or more.

BACKGROUND ART

The fuel pressure of the conventionally and generally known gasoline direct injection system is 20 MPa or less. In general, a rail body having a fuel passage inside is used by connecting an injector holder, a mounting boss and the like with the rail body by brazing. When the fuel pressure is within the above described range, sufficient pressure resistant strength can be obtained even if the thickness of the rail body is relatively thin, and an injector and an injector holder can be connected with each other sufficiently by the sealing using only an O-ring. Accordingly, it is not particularly necessary to use a high strength material for the rail.

On the other hand, in a diesel common rail system using higher fuel pressure, the rail body is manufactured by forging and cutting for ensuring high pressure resistance of the rail body itself. However, since the fuel pressure is high, an O-ring cannot be used for connecting with the injector, a pipe should be arranged between the rail and the injector and they should be connected by a metal seal.

Furthermore, the fuel pressure of the gasoline direct injection system becomes higher (exceeding 50 MPa) in recent years through improvement of the fuel and strengthening of the exhaust emission regulations. Accordingly, the thickness of a fuel rail should be formed thicker to withstand higher pressure. Thus, there is a problem that sufficient pressure resistance cannot be obtained by the conventional method of brazing a block to the pipe member. In addition, although an O-ring is conventionally used for the connection with the injector, the sealing of the O-ring reaches the limit as the pressure increases. Thus, same as the above described diesel common rail system, the injector should be connected by a metal seal. In order to apply the same structure as the diesel common rail system to a high pressure-resistant rail, it is considered that the rail is integrally formed by forging as shown in Patent Document 1.

Patent Document 1: WO2016/042897

DISCLOSURE OF THE INVENTION

Problems to be Solved by the Invention

Here, it is known that the pressure resistance is weak at a portion near a branch hole leading to a metal seal portion, and it is necessary to increase the thickness at the portion near the branch hole. However, in the forged rail shown in Patent Document 1, it cannot be avoided to increase also the thickness at the other portions than the portion near the branch hole, and the weight is inevitably increased.

In addition, if the above described forged rail having the increased thickness is manufactured by using a stainless material which is frequently used in the gasoline system, the rail becomes extremely expensive. Furthermore, since the position and direction of forming the joint part is fixed to a predetermined direction, layout property is deteriorated. In addition, the material having a certain hardness should be used for the metal seal portion to prevent the deformation caused by the connection. Thus, if high strength material is used for the entire portions of the high pressure rail, the cost becomes higher.

Thus, the present invention aims for solving the above described problems to obtain a fuel rail for gasoline direct injection which can be used for the direct injection at a high fuel pressure of 50 MPa or more by increasing the thickness at the portion near the branch hole and using the material having high thickness for the metal seal portion while keeping the weight light and keeping the cost low.

Means for Solving the Problem

The present invention is made for solving the above described problems and relates to a fuel rail for gasoline direct injection made of steel and used at a fuel pressure of 50 MPa or more, the fuel rail comprising: a plurality of block members; and a pipe member which connects an interval between the block members, wherein the block members have: branch hole which communicates with the pipe member; and a metal seal portion to which an injector is connected, and the hardness of the block members is higher than the hardness of the pipe member.

Note that the hardness of the block members is preferably higher than the hardness of the pipe member by 30 HV or more. Because of this, while the pressure resistance of the block members is kept good at the portion near the branch hole, the weight of the entire the product can be reduced and the cost of the material can be more significantly reduced.

In addition, a reinforcing member can be installed in the interval between the block members in an arrangement direction of the pipe member to increase rigidity of the interval between the block members.

Effects of the Invention

As described above, a plurality of block members and a pipe member are provided, and a branch hole and a metal seal portion are provided on the block members in the present invention. Thus, the thickness of the pipe member can be formed thinner and only the thickness of the portion near the branch hole can be formed thicker since the pressure resistance is not particularly important at the pipe member. Accordingly, the weight of the entire product can be lighter compared to the conventional forged product.

In addition, since the hardness of the block members is higher than the hardness of the pipe member, the deformation of the metal seal portion can be prevented when connected with the injector by increasing the strength of the metal seal portion of the block members. As described above, since the material having high hardness is used only for the block members, it is not necessary to use expensive material having high hardness for the entire product. Thus, the cost can be kept low. From the above, while the pressure resistance of the block members is kept good at the portion near the branch hole, the weight of the entire the product can be reduced and the cost of the material can be reduced.

MODES FOR CARRYING OUT THE INVENTION

First Embodiment

Figure 1:
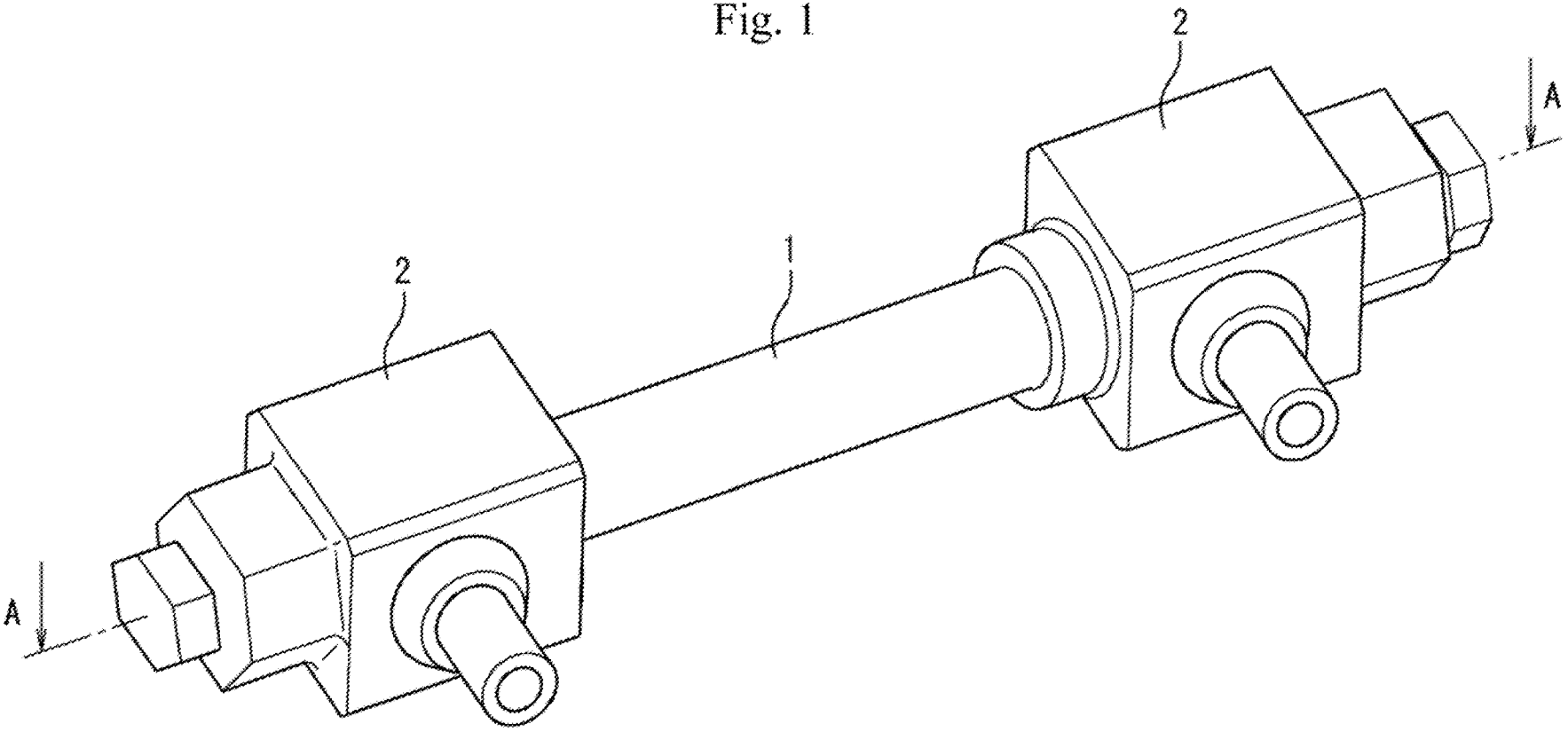
FIG. 1 is a perspective view showing the first embodiment of the present invention.
Figure 2:
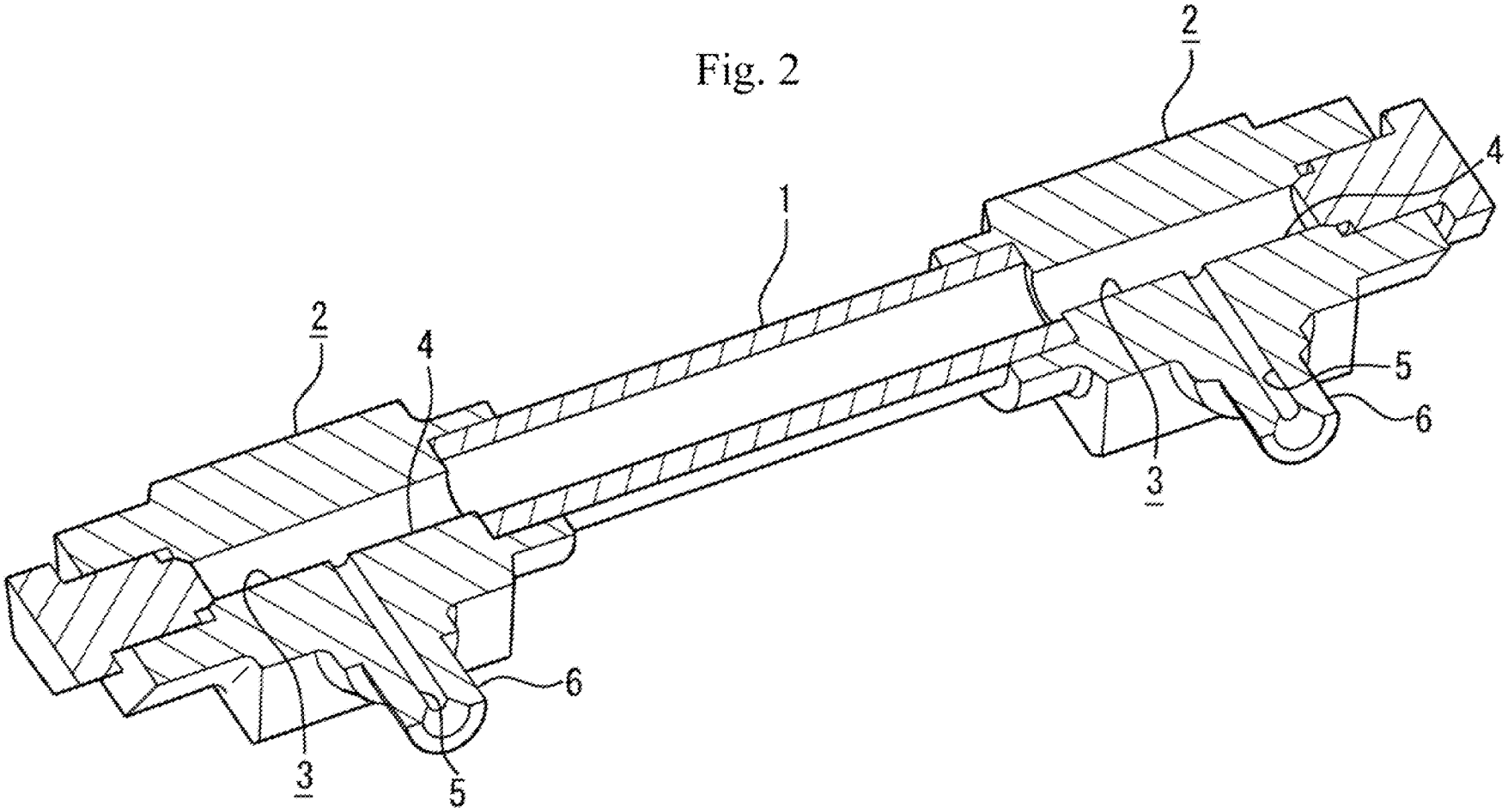
FIG. 2 is a cross-sectional view cut along line A-A in FIG. 1.
Figure 3:
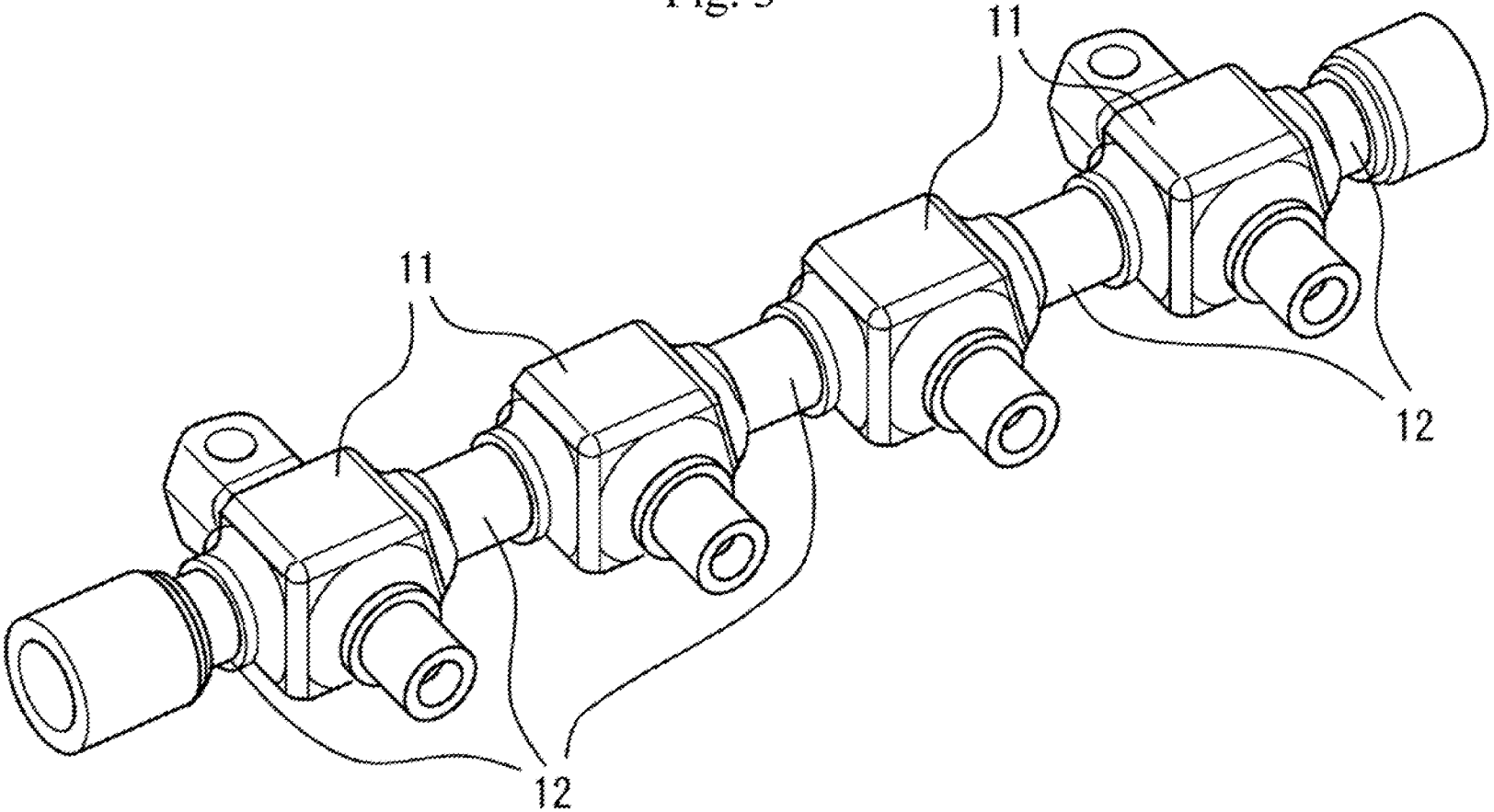
FIG. 3 is a perspective view showing the second embodiment.

The first embodiment of the present invention will be explained below in FIGS. 1 and 2. (1) is a pipe member, and block members (2) formed separately from the pipe member (1) are provided on both ends of the pipe member (1). In addition, a branch hole (3) is provided on the block members (2) as shown in FIG. 2. As shown in FIG. 2, the branch hole (3) has a T-shape formed by a communication passage (4) extending along an arrangement direction of the pipe member (1) to communicate with the pipe member (1) and a branch passage (5) extending in a vertical direction from the center part in a longitudinal direction of the communication passage (4).

As described above, since the branch hole (3) is provided on the block members (2), the thickness of the pipe member (1) at which the pressure resistance is not particularly important can be formed thinner and only the thickness of the portion near the branch hole (3) at which the pressure resistance is required can be formed thicker. In addition, a metal seal portion (6) is projected at the tip end side of the branch passage (5) to connect an injector with the metal seal portion (6).

In addition, since the block members (2) and the pipe member (1) are separately formed, the block members (2) and the pipe member (1) can be made of different materials with each other. Accordingly, it is possible to use the material having high pressure resistance for the block members (2) compared to the hardness of the material used for the pipe member (1) since higher pressure resistance is required for the block members (2).

For example, the material of the block members (2) can be SUS materials such as Duplex, SUS630, EN1.4418, SUS304N2 and steel materials such as S45C, S55C, SCM420, SCM 430, SCM 435, SCM 440. The material of the pipe member (1) can be SUS materials such as SUS304, SUS304L, SUS 316, SUS 316L and steel materials such as STS370, STKM17, STKM 20, STKM 13 which have lower hardness compared to the above exemplified materials of the block members (2).

As described above, since expensive material having high hardness can be used only for the block members (2), the cost can be kept low. In addition, since the material having high hardness is used for the block members (2), even if the fuel pressure is high, breakage of the branch hole (3) can be prevented. Furthermore, since the metal seal portion (6) provided on the block members (2) also has high hardness, the pressure resistance can be increased at the metal seal portion (6). Thus, the deformation of the metal seal portion (6) can be prevented when connected with the injector.

Second Embodiment

Although two block members (2) are connected with the pipe member (1) in the above described first embodiment, it is also possible to connect four block members (11) with a pipe member (12) as shown in the second embodiment. Furthermore, it is also possible to connect 3, 5 or more block members in the different embodiments. Note that the configurations of the block members (11) and the pipe member (12) are same as those described in the first embodiment.

Third Embodiment

Figure 4:
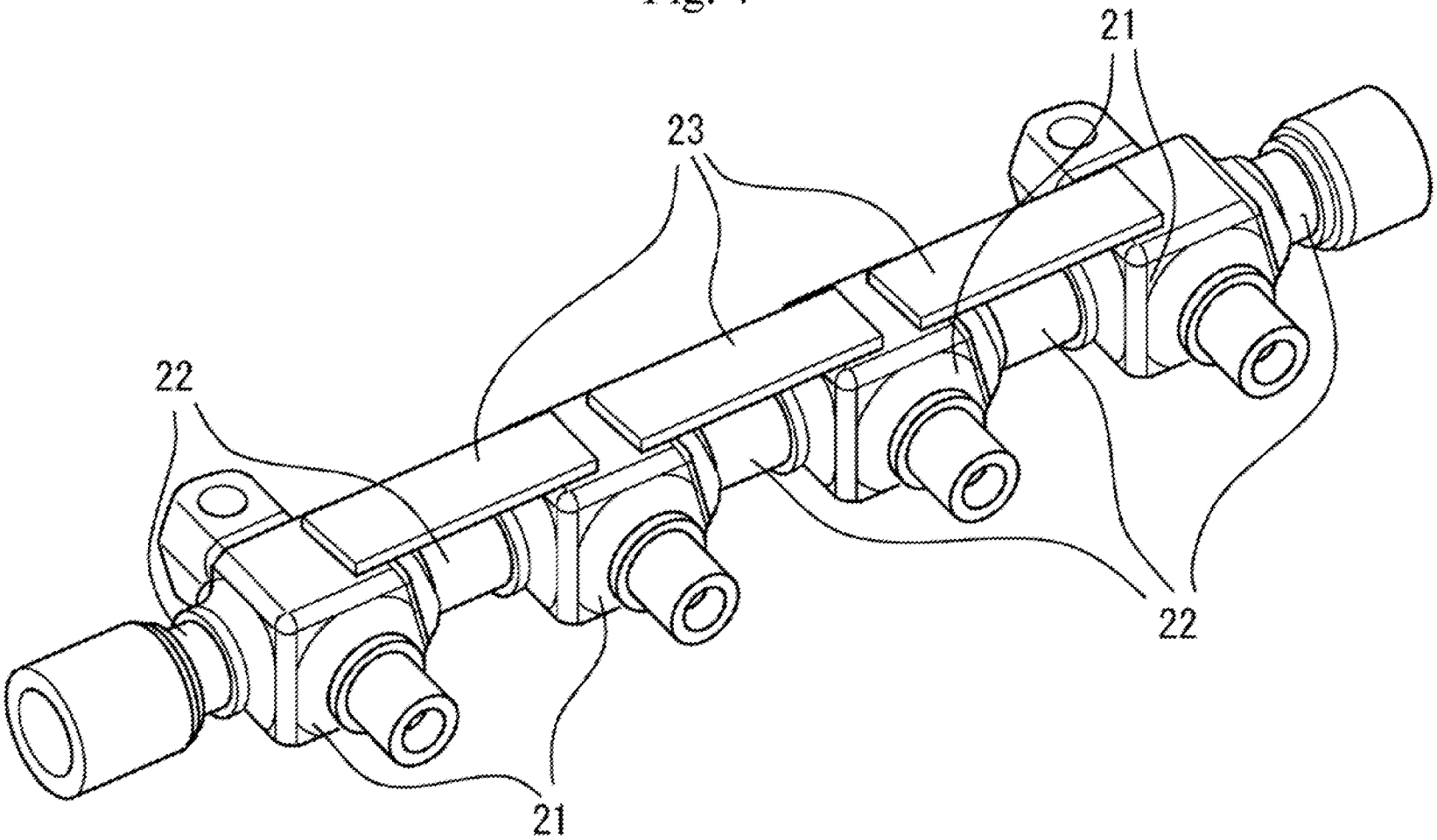
FIG. 4 is a perspective view showing the third embodiment.

In the third embodiment, same as the second embodiment, four block members (21) are connected with a pipe member (22). Furthermore, as shown in FIG. 4, a reinforcing member (23) is installed in an interval between the neighboring block members (21) in the arrangement direction of the pipe member (22). As described above, since the reinforcing member (23) is installed, the rigidity between the block members (21) can be increased. In the third embodiment, same as the second embodiment, the configurations of the block members (21) and the pipe member (22) are same as those described in the first embodiment.

DESCRIPTION OF THE REFERENCE NUMERALS

1, 12, 22 pipe member
2, 11, 21 block member
3 branch hole
6 metal seal portion
23 reinforcing member

The invention claimed is:

1. A fuel rail for gasoline direct injection made of steel and used at a fuel pressure of 50 MPa or more, the fuel rail comprising:

a plurality of block members; and a pipe member which connects an interval between the block members, wherein the block members have:

a branch hole which communicates with the pipe member; and a metal seal portion to which an injector is connected, and the hardness of the block members is higher than the hardness of the pipe member.

2. The fuel rail for gasoline direct according to claim 1, wherein a reinforcing member is installed in the interval between the block members in an arrangement direction of the pipe member to increase rigidity of the interval between the block members.

* * * * *